United States Patent [19]

Bailey

[11] 4,059,334

[45] Nov. 22, 1977

[54] BLADE TYPE FUSE CLIP ASSEMBLY

[75] Inventor: William R. Bailey, Melrose Park, Ill.

[73] Assignee: Eltra Corporation, New York, N.Y.

[21] Appl. No.: 696,875

[22] Filed: June 17, 1976

[51] Int. Cl.[2] ..... H01R 11/22; H01H 85/20; H01H 85/24

[52] U.S. Cl. ..... 339/258 F; 339/61 R

[58] Field of Search ..... 339/219 F, 253 F, 256 C, 339/258 F, 259 F, 262 F, 184 R, 61 R

[56] References Cited

U.S. PATENT DOCUMENTS

| | | | |
|---|---|---|---|
| 3,198,913 | 8/1965 | Stanback | 339/258 F |

FOREIGN PATENT DOCUMENTS

| | | | |
|---|---|---|---|
| 535,810 | 4/1941 | United Kingdom | 339/262 F |
| 885,319 | 12/1961 | United Kingdom | 339/258 F |
| 1,250,043 | 10/1971 | United Kingdom | 339/258 F |

*Primary Examiner*—Roy Lake
*Assistant Examiner*—Neil Abrams
*Attorney, Agent, or Firm*—Lockwood, Dewey, Zickert & Alex

[57] ABSTRACT

An improved fuse clip assembly for receiving and retaining one end of a blade type fuse. The assembly includes an inexpensively produced extruded electrically conductive member which includes, both, an improved fuse blade contact surface, and a terminal connector. The assembly also includes a resilient member which presses a fuse blade inserted in the assembly against the contact surface on the extruded member for improved electrical surface contact therewith. Since the terminal connector and electrical contact surface are integrally formed in one member. The resilient member can be inexpensively made of a dielectric material.

3 Claims, 7 Drawing Figures

BLADE TYPE FUSE CLIP ASSEMBLY

BACKGROUND OF THE INVENTION

This invention relates to improvements in a fuse clip assembly which releasably retains one end of a blade type cartridge fuse when inserted therein. Two such clips are utilized with each fuse positioned in an electrical circuit. More specifically, this invention relates to an improved blade type fuse clip assembly wherein one of the members forming the clip includes both, an improved fuse blade contact surface, and a terminal connector. This integral contact-connector member is formed from an extrusion thus providing high surface tolerances for maximum electrical surface contact with the fuse blade at minimum material cost. Also, since the terminal connector and blade fuse surface are integrally formed in a single member, a more efficient fuse clip is produced. Additionally, a resilient second member of the fuse clip assembly presses the fuse blade against the contact surface on the extruded member. This second resilient member need not be made of expensive electrically conductive material, and can be inexpensively formed of a plastic material, thus saving considerable raw material and manufacturing expense.

Heretofore, blade type fuse clips generally used for electrical or industrial applications have included members which provide both fuse blade surface contact and terminal connector contact in one member. IBM Technical Disclosure Bulletin Vol. 7, No. 1, June 1964, discloses a single member which functions as both a terminal connector for a board pin and as a receptacle for a spade terminal. However, this device is formed from sheet metal and would provide electrical contact surfaces of inferior quality to applicant's invention. British Pat No. 535,810, accepted Apr. 23, 1941, is directed to fuse clips and includes one embodiment utilizing a block having integrally formed thereon a terminal connector and fuse blade contact surface. The assembly also includes a second resilient member for maintaining the fuse blade contact with the block. However, there is no mention in this patent of forming the block out of extruded material so as to obtain a precision contact surface at low cost. Neither is there any disclosure that the second resilient member may be formed of non-electrically conductive material. Therefore, applicant's invention provides an improved fuse clip which may be produced in a substantial cost saving over the production cost of the fuse clips disclosed in the British patent.

BRIEF SUMMARY OF THE INVENTION

Applicant's invention is directed to an improved fuse clip assembly for receiving and retaining one end of a blade type cartridge fuse. The assembly includes a terminal connector block and a resilient member attached thereto for retaining the blade of a fuse against the block. The block is a generally L-shape polyhedron having a flat base, a apir of L-shape side surfaces, an elongate back surface, upper and lower substantially vertical front surfaces connected by a substantially horizontal surface therebetween, and an acutely angled top surface extending upwardly from the top of the back surface to the top of the upper front surface. A hole extends through the block from one L-shape side to the other and includes fastener means in communication with the hole for retaining any electrical connector positioned in the hole. The assembly also includes a resilient L-shape member having a horizontal base upon which the terminal connector block is mounted, and a generally vertical arm extending upward from the base. The arm is positioned parallel to the back surface of the block so as to retain a fuse blade, positioned therebetween, in full surface contact with said block back surface.

The invention is further directed to a fuse clip assembly including an extruded block member functioning as, both, a terminal connector and a fuse blade contact surface, and a resilient arm mounted to said block for maintaining a fuse blade in surface contact with the block, the arm being inexpensively made of a dielectric material.

It is therefore an object of the invention to provide a blade type fuse clip assembly which provides more efficient electrical contacts at lower production costs than prior fuse clip assemblies.

Another object of the invention is to provide an improved blade type fuse clip assembly including an extruded block member which includes both an electrical fuse blade contact surface and a terminal connector therein.

A further object of the invention is the provision of a blade type fuse clip assembly including a resilient arm made of dielectric material and mounted to the block member therein so as to maintain a fuse blade placed therebetween in surface contact with the block member.

BRIEF DESCRIPTION OF THE DRAWINGS

Other objects, features and advantages of the invention will be apparent from the following detailed disclosure, taken in conjunction with the accompanying drawings, wherein like references numerals refer to like parts in which.

DETAILED DESCRIPTION OF THE INVENTION

Figure 1:
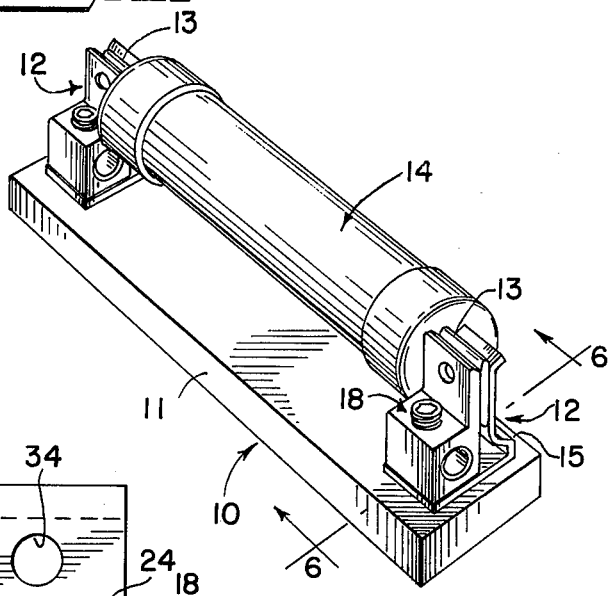
FIG. 1 is a perspective view of a blade fuse mounting assembly including a pair of improved fuse clips of the invention.

Referring to FIG. 1, a blade type fuse mounting assembly incorporating the invention is shown at 10. The assembly 10 includes a base panel 11 made of a dielectric material, and a pair of improved fuse holding clips 12—12 of the invention. The fuse clips 12—12 are mounted on the panel in sufficient spatial relation such that each blade end 13 of a blade type cartridge fuse 14 may be inserted into one of the respective clips. Each clip 12 includes a resilient spring-like member 15 forming the base 16 and an arm 17 of the clip, and an extruded block 18 which is mounted to the base 16 of resilient member 15 such that it is positioned in spatial relation to the resilient arm 17 for allowing the fuse blade 13 to be inserted and biased therebetween.

Figure 2:
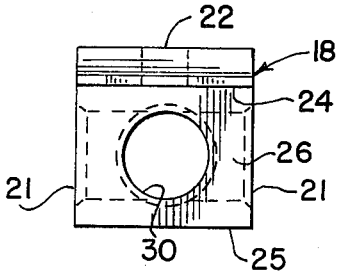
FIG. 2 is a top plan view of the extruded member of the fuse clip assembly providing the integral fuse blade contact surface and terminal connector.
Figure 3:
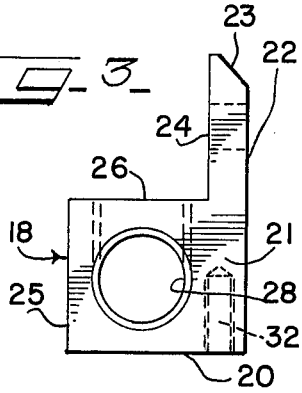
FIG. 3 is a side-elevational view of the extruded member.
Figure 4:
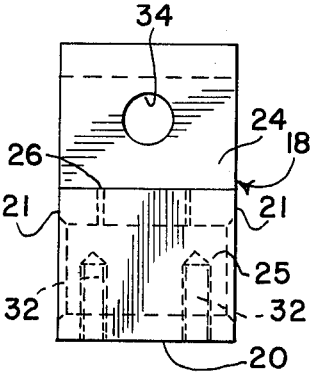
FIG. 4 is a front-elevational view of the extruded member.

The extruded block 18 is shown in more detail in FIGS. 2, 3 and 4. Block 18 includes a generally rectangular bottom surface 20, two identical L-shape sides 21—21 including a substantial rectangular bottom portion and a relatively slender upwardly extending top portion. An elongate vertical back surface 22 extends upward from base surface 20 between the side surfaces 21—21. The back surface 22 is flat and true thus providing full surface contact with one side of the fuse blade 13 when it is inserted in a completed fuse clip 12. A sloped surface 23 extends at an acute angle upwardly from the top of back surface 22 to form the top most surface of block 16. Surface 23 co-acts with an opposing sloped surface 27 on resilience member 15 to guide the insertion of a fuse blade 13 therebetween. Upper and lower vertical front surfaces 24, 25 respectively, together with a horizontal flat rectangular surface 26 therebetween complete the basic outer surfaces of block 18. Outer block surfaces 20, 22, 23, 24, 25 and 26 are inexpensively formed to high tolerances as the electrically conductive material making up block 18 is extruded through a die (not shown). Flat side surfaces 21—21 may be formed by sawing, machining, or otherwise separating segments of a bar of the extruded material.

Block 16 also functions as a terminal connector to which electrical leads (not shown) may be securely attached. A round hole 28 extends through the substantial lower portion of block 16 from one side surface 21 to the opposing side surface 21. As the cylindrical surface of hole 28 is formed parallel to the previously mentioned side surfaces formed by the extrusion die (not shown), hole 28 may also be formed during the extrusion process, or may be formed by other machining methods or the like after the block is severed from the extruded bar. A second round hole 30 extends vertically downward from horizontal surface 26 until it intersects hole 28. Hole 30 is threaded in this embodiment so an allen head bolt 31 can be threaded therein. The allen head bolt 31 may be threaded downwardly in hole 30 to secure any electrical lead (not shown) which is positioned in the first round hole 28. It can be understood that other fastening means may be utilized in block 30 to secure a electrical lead therein. Additional threaded holes 32—32 extending upwardly from the bottom surface 20 of block 18 facilitate securing block 18 to the base 16 of resilient member 15 through the use of mounting screws 33 or the like. An additional hole 34 which extends horizontally from upper front surface 24 through the slender upper portion of block 16 to the back side 22 thereof. Hole 34 provides a mounting for a means for limiting the types of fuses which may be insertable in the fuse clip 12, and will be discussed in greater detail below.

Figure 5:
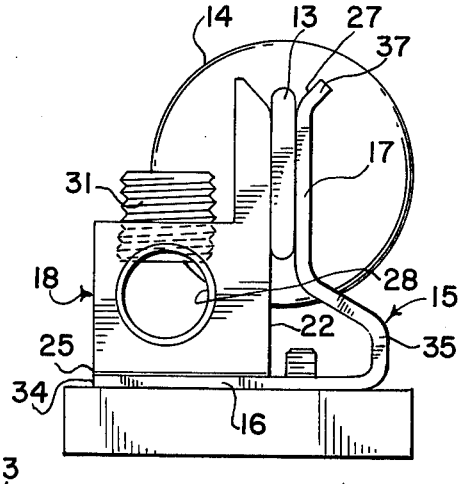
FIG. 5 is an end-elevational view of the blade fuse mounting assembly shown in FIG. 1.
Figure 6:
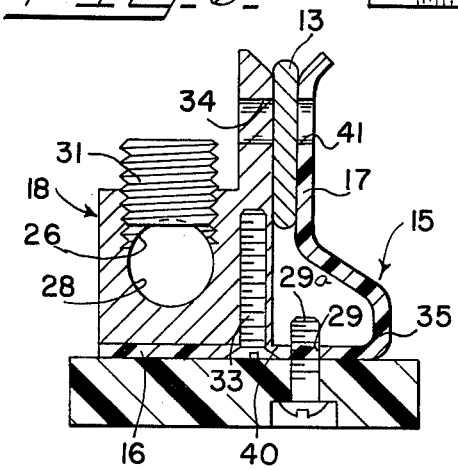
FIG. 6 is a cross-sectional view taken substantially along line 6—6 of FIG. 1.

As shown most clearly in FIGS. 5 and 6, the fuse clip assembly 12 of the invention also includes the generally L-shape resilient member 15 which has a horizontal base 16, a backwardly bent U-shape or bight portion 35, and a free standing arm 17 including an acutely bent distal end 37. The extruded block 18 and resilient member 15 are assembled together to form the fuse clip 12 of the invention by mounting the block base surface 20 to the top of the horizontal base 16 of resilient member 15 such that the lower front surface 25 of the block 16 is aligned with the distal end 34 of the base 16 of resilient member 15. Holes 40—40 extending through the base 34 of resilient member 15 are positioned to align with small threaded holes 32—32 in block 16 in order that the two members may be secured together by flat head bolts 33. An additional threaded hole 29 through base 16 provides for mounting each clip 12 to the insulator panel 11 with a bolt **29*a*. It can be understood that other means for fastening the block 16 to the resilient member 15 and for fastening the clip 12 to insulating panel 11** may be utilized within the scope of the invention.

The size and shape of block 18 and resilient member 15 are such that when the block is mounted on top of the resilient member, the elongated back surface 22 or block 18 is positioned in generally parallel closely spaced relation to the straight arm 36 of member 15. Also, when the block and resilient member are mounted together, sloped surface 23 on block 18 is positioned at approximately the same height as is the acutely bent surface 27 of distal end 37 on arm 17. Both sloped surfaces 23 and 27 co-act to guide the insertion of the end 13 of a blade type cartridge fuse 14 into the open space between block 18 and member 15.

The space between arm 36 and block back surface 22 is slightly less than the thickness of the fuse blade 13 which is intended to be inserted therebetween. The arm 17 of resilient member 15 is moved outwardly of back surface 22 when a fuse blade 13 is inserted therein. The resilience in arm 17 then presses one side of blade 14 into full surface contact with the accurately formed flat back surface 22 of block 16 to provide a superior electrical contact therebetween. It should be noted a full surface electrical contact between one side of a fuse blade and a terminal connector is superior to a two sided partial surface contact between a fuse blade and a typical blade type fuse clip having a pair of resilient members, one on either side of each fuse blade.

Since the fuse clip 12 is designed to give a full surface contact with one side of blade 13 contacting the back surface 22 of block 18, it is not necessary that resilient member 15 be made of expensive electrically conductive material.

Therefore, resilient member 15 may be made of an inexpensive non-metallic material such as plastic, hard rubber, or the like in order to lessen the manufacturing and production expense usually associated with blade type fuse clips.

Figure 7:
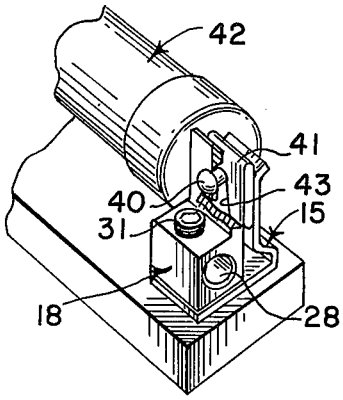
FIG. 7 is a partial perspective view of the fuse clip mounting shown in FIG. 1 which further embodies a blocking structure which prevents the insertion of a standard blade type fuse, but permits the insertion of a class-R current-limiting fuse therein.

A modification of the blade type fuse clip which allows only class-R current-limiting fuses to be inserted therein is shown in FIG. 7. In this modification, a rivet 40 or similar blocking device is inserted through hole 34 in block 18 and through a similar hole 41 (FIG. 6) aligned therewith in the arm portion 17 of resilient member 15. Rivet 40 prevents the insertion of a typical solid fuse blade into the clip. The blade 41 of a class-R current-limiting fuse 42 includes a generally U-shape cutout 43 which extends upwardly from the bottom of blade 41 such that it may avoid the rivet when inserted in the modified clip. The rivet 40 must be secured through its mounting holes in a manner that does not restrain the necessary movement of resilient member 14 relative the back surface 22 of block 16. The modification of fuse clip 12 into one which is capable of receiving only a class-R current-limiting fuse is meant to comply with a National Electric Code Safety Requirement that fuse holders for current limiting fuses shall not permit insertion of fuses that are not current-limiting.

While a particular embodiment of the invention has been shown and described, it will be obvious to those skilled in the art that changes and modifications may may be made without departing from the invention in its broader aspects, and therefore, the aim in the appended claims is to cover all such changes and modifications as fall within the true spirit and scope of the invention.

I claim:

1. In a fuse clip assembly for receiving and retaining one end of a blade type cartridge fuse, said assembly comprising;

a terminal connector block made of electrically conductive material and formed from an extrusion, said terminal connector block being a generally L-shape polyhedron having a substantially flat base, a pair of L-shape side surfaces extending upward from opposing edges of said base, an elongate back surface extending upward from said base and in communication with said L-shape sides, said back surface being flat for providing an efficient electrically conductive surface contact between said block and the blade of a fuse positioned in said clip;

the front of said block including upper and lower substantially vertical surfaces connected by a substantially horizontal surface therebetween, and a top surface of said block being acutely angled with said back surface and extending upwardly therefrom toward the top of said upper front surface;

a hole extending through said block from a bottom portion of one L-shape side thereof to a bottom portion of the other, fastener means positioned in communication with said hole for retaining an electrical conductor positioned in said hole;

a resilient generally L-shape member made of a dielectric material and including a horizontal base toward the distal end of which said base of said block is mounted, and a generally vertical arm extending upward from said base, a portion of said arm being positioned generally parallel to said block back surface in close spatial relation thereto, whereby a blade end of a blade type fuse may be positioned between said block back side and said arm and be maintained in full surface contact with said back side by said resilient arm.

2. The fuse clip assembly of claim 1 wherein said block includes an aperture therein in communication with said back side thereof, and a bar means inserted in said aperture which protrudes therefrom across said space between said block back side and said resilient member arm portion for preventing the insertion into said clip of fuses other than those of current-limiting configuration.

3. The fuse clip assembly of claim 2 wherein said arm portion of said resilient member includes a hole therethrough which is aligned with said back side aperture, and said bar means extends into said hole.

* * * * *